US008894378B2

(12) United States Patent
Jayana

(10) Patent No.: US 8,894,378 B2
(45) Date of Patent: Nov. 25, 2014

(54) SYSTEMS, METHODS, AND APPARATUS FOR SEALING A BUCKET DOVETAIL IN A TURBINE

(75) Inventor: Srinivasa Govardhan Jayana, Bangalore (IN)

(73) Assignee: General Electric Company, Schenectady, NY (US)

( * ) Notice: Subject to any disclaimer, the term of this patent is extended or adjusted under 35 U.S.C. 154(b) by 586 days.

(21) Appl. No.: 13/191,214

(22) Filed: Jul. 26, 2011

(65) Prior Publication Data

US 2013/0028708 A1 Jan. 31, 2013

(51) Int. Cl.
*F01D 5/30* (2006.01)
*F01D 11/00* (2006.01)

(52) U.S. Cl.
CPC ..... *F01D 11/006* (2013.01); *F01D 5/3015* (2013.01)
USPC ..... 416/248; 416/204 A; 416/239

(58) Field of Classification Search
CPC ..... F01D 5/14; F01D 5/30; F01D 5/3015; F01D 5/3007; F01D 29/322; F01D 11/006
USPC ..... 416/219 R, 239, 248, 220 R, 221, 204 A, 416/244 A
See application file for complete search history.

(56) References Cited

U.S. PATENT DOCUMENTS

| | | | | |
|---|---|---|---|---|
| 5,138,389 | A | 8/1992 | Randall | |
| 5,257,909 | A | 11/1993 | Glynn et al. | |
| 5,318,405 | A * | 6/1994 | Meade et al. | 416/220 R |
| 5,558,500 | A | 9/1996 | Elliott et al. | |
| 6,296,172 | B1 | 10/2001 | Miller | |
| 2009/0252611 | A1 * | 10/2009 | Tipton et al. | 416/220 R |
| 2010/0007096 | A1 * | 1/2010 | Ward et al. | 277/595 |
| 2010/0008781 | A1 * | 1/2010 | Ward et al. | 416/213 R |
| 2010/0008783 | A1 | 1/2010 | Arness et al. | |
| 2010/0178169 | A1 * | 7/2010 | Webb | 416/95 |

* cited by examiner

*Primary Examiner* — Edward Look
*Assistant Examiner* — Adam W Brown
(74) *Attorney, Agent, or Firm* — Sutherland Asbill & Brennan LLP

(57) ABSTRACT

Certain embodiments of the invention may include systems methods, and apparatus for sealing a bucket dovetail in a turbine. According to an example embodiment of the invention, a method is provided for sealing a gap between a bucket dovetail and a rotor wheel slot. The method can include providing a bucket tab associated with a bucket dovetail, wherein the bucket tab is configured to accept a seal tab; configuring the bucket tab and the seal tab to engage at least one dimension upon insertion of the seal tab into the bucket tab; and sealing a gap between the bucket dovetail and a rotor wheel slot with the seal tab; wherein at least a portion of the seal tab changes as a function of temperature for further sealing gap between the bucket dovetail and the rotor wheel slot.

14 Claims, 8 Drawing Sheets

SYSTEMS, METHODS, AND APPARATUS FOR SEALING A BUCKET DOVETAIL IN A TURBINE

FIELD OF THE INVENTION

This invention generally relates to a turbine, and more particularly, to systems, methods and apparatus for sealing a bucket dovetail in a turbine.

BACKGROUND OF THE INVENTION

Gas turbines generally include a turbine rotor (often referred to as a wheel) with a number of buckets (or blades) circumferentially attached to the rotor by dovetails. The buckets may project into the hot gas path to convert the kinetic energy of the gas into rotational mechanical energy. To avoid overheating and damaging the buckets, cooling air can be introduced into passages that extend radially through the bucket. One of the challenges associated with cooling the bucket is to keep the cool air from leaking through the gap between the tabs of the dovetails and the surface of the rotor, particularly during operation and under conditions of centrifugal loads and thermal expansion. When air leaks into the wheel space, it may be necessary to increase the cooling airflow to maintain the bucket cooling requirements. Consequently, the output and overall efficiency of the turbine may be reduced, for example, due to the extra load on the cooling air compressors.

BRIEF SUMMARY OF THE INVENTION

Some or all of the above issues may be addressed by certain embodiments of the invention. Certain embodiments of the invention may include systems, methods, and apparatus for sealing a bucket dovetail in a turbine.

According to an example embodiment of the invention, a method is provided for sealing a gap between a bucket dovetail and a rotor wheel slot. The method includes providing a bucket tab associated with a bucket dovetail, wherein the bucket tab is configured to accept a seal tab; configuring the bucket tab and the seal tab to engage at least one dimension upon insertion of the seal tab into the bucket tab; and sealing a gap between the bucket dovetail and a rotor wheel slot with the seal tab; wherein at least a portion of the seal tab changes as a function of temperature for further sealing gap between the bucket dovetail and the rotor wheel slot.

According to another example embodiment, a system is provided. The system includes a turbine. The turbine includes a rotor; one or more rotor wheels connected to the rotor, wherein the one or more rotor wheels comprise one or more rotor wheel slots; one or more buckets each comprising a bucket dovetail; one or more bucket tabs associated with each bucket dovetail; and one or more seal tabs configured for sealing a gap between the bucket dovetail and the rotor wheel slot and further configured to engage the one or more bucket tabs upon insertion of the one or more seal tabs into the one or more bucket tabs.

According to another example embodiment, an apparatus is provided for sealing a gap between a bucket dovetail and a rotor wheel slot in a turbine. The apparatus includes one or more bucket tabs associated with a bucket dovetail; and one or more seal tabs configured for sealing a gap between the bucket dovetail and a rotor wheel slot and further configured to engage the one or more bucket tabs upon insertion of the one or more seal tabs into the one or more bucket tabs.

Other embodiments, features, and aspects of the invention are described in detail herein and are considered a part of the claimed inventions. Other embodiments, features, and aspects can be understood with reference to the following detailed description, accompanying drawings, and claims.

BRIEF DESCRIPTION OF THE FIGURES

Reference will now be made to the accompanying tables and drawings, which are not necessarily drawn to scale, and wherein.

DETAILED DESCRIPTION OF THE INVENTION

Embodiments of the invention will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Certain embodiments of the invention may enable sealing an interface between a bucket and a rotor in a turbine. According to certain example embodiments, a seal tab may be provided for sealing an interface associated with a bucket dovetail. Example embodiments of the invention can provide a seal that includes material having a thermal expansion coefficient that can provide additional sealing as the temperature rises, for example, during the operation of the turbine. In certain example embodiments, the seal may include a seal tab that can be attached to a modified bucket tab.

Various parts, materials, and arrangements for example embodiments of the invention will now be described with reference to the accompanying figures.

Figure 1:
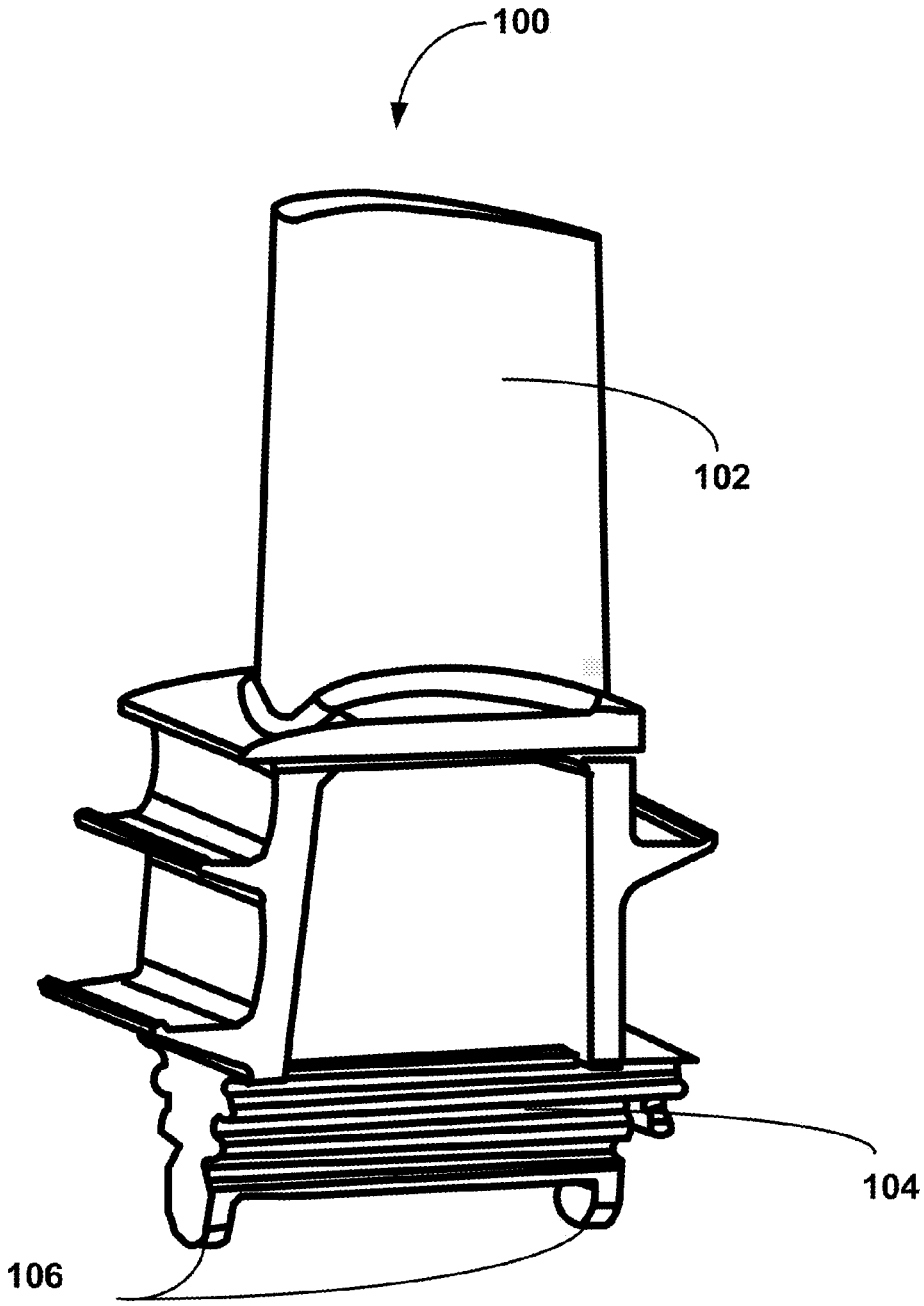
FIG. 1 is a block diagram of an illustrative blade assembly according to an example embodiment of the invention.

FIG. 1 illustrates an example blade or bucket assembly 100, which includes a rotor blade 102, a bucket dovetail 104, and a bucket tab 106.

Figure 2:
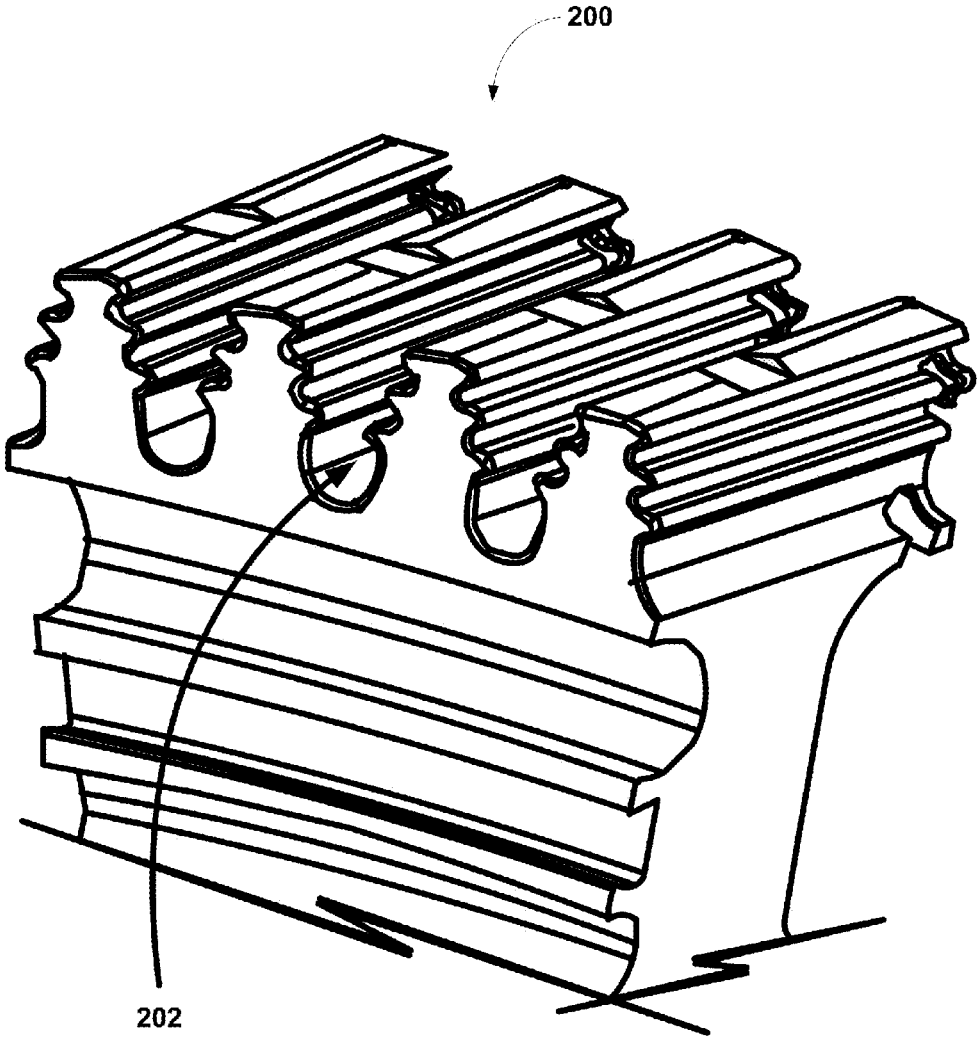
FIG. 2 is a block diagram of an illustrative rotor wheel according to an example embodiment of the invention.

FIG. 2 depicts a portion of a rotor wheel 200, and a rotor wheel slot 202 that can interface with the bucket dovetail (as in 104 of FIG. 1).

Figure 3:
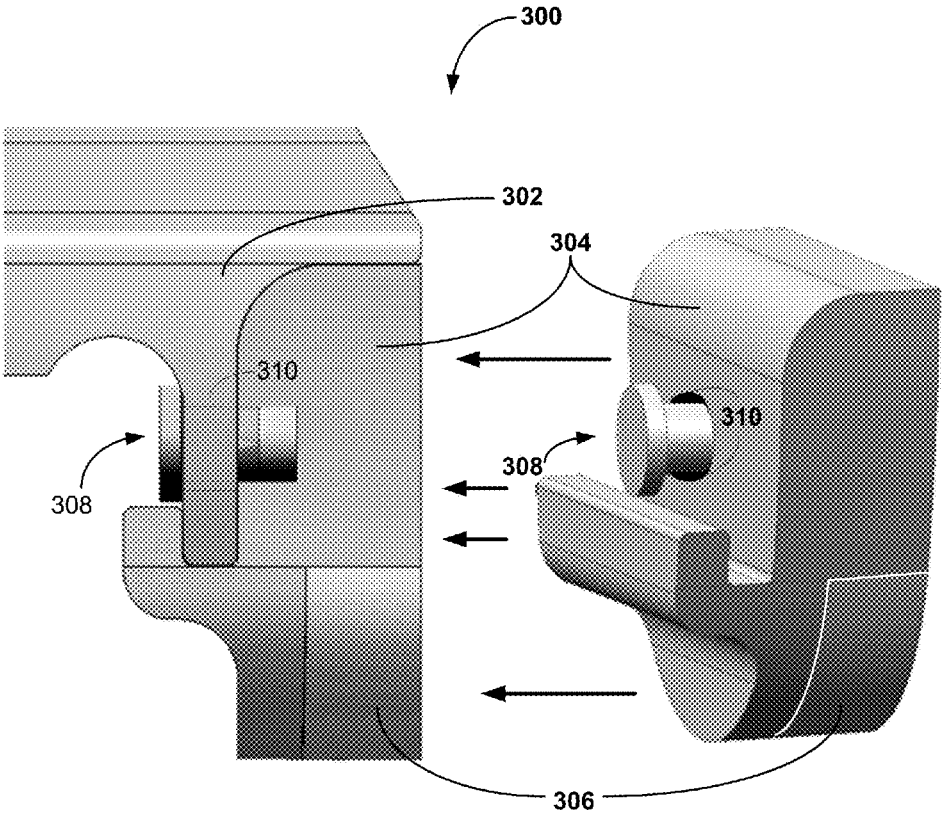
FIG. 3 is a block diagram of an illustrative bucket tab seal according to an example embodiment of the invention.

FIG. 3 depicts a bucket tab seal assembly 300 according to an example embodiment of the invention. The assembly 300 may attach to a modified bucket tab 302. In one example embodiment, a portion of a bucket tab 302 may be removed to provide room for attaching a retrofit seal tab 304 to the bucket tab 302. In an example embodiment, the retrofit seal tab 304 may include a material that includes a sealing surface 306.

According to an example embodiment, a retaining device, such as a retaining pin 308 may be utilized to secure the seal tab 304 to the bucket tab 302.

According to an example embodiment, the material associated with the sealing surface 306 may include a nickel/iron alloy. For example, an alloy known as A-286 may be utilized for all or part of the seal tab 304. Alloy A-286 is designed for applications requiring high strength and good corrosion resistance at temperatures up to about 1300° F. (704° C.). This alloy offers high ductility in notched sections, with a rupture strength superior to many other commercial alloys with comparable high temperature properties. One characteristic of this alloy is the ability to be precipitation hardened and strengthened by heat treatments. This makes possible a high degree of uniformity in developing maximum strength, which can be repeated numerous times. The thermal expansion of A-286 ranges from about 16 ppm/degree C. to about 19 ppm/degree C. According to an example embodiment of the invention a retaining pin bore 310 may be oversized, as shown in FIG. 3, to allow the seal tab 304 to self align within the bucket dovetail. Another feature associated with the oversized retaining pin bore 310, according to an example embodiment, is to allow the seal tab 304 to expand differently than the bucket tab 302, for example, as a result of the seal tab 304 being made with a material of a higher coefficient of thermal expansion than the bucket tab 302.

Figure 4:
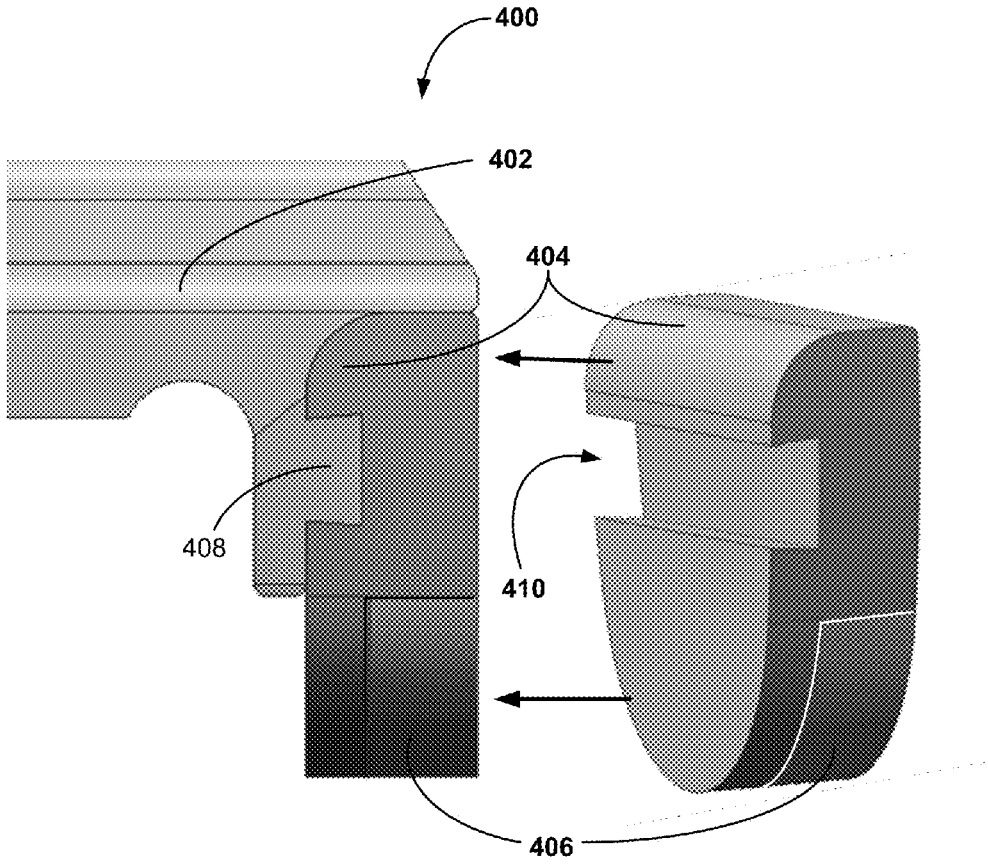
FIG. 4 is a block diagram of another illustrative bucket tab seal according to an example embodiment of the invention.

FIG. 4 depicts another example bucket tab seal embodiment 400. According to example embodiments of the invention, a bucket tab 402 may be modified so that a seal tab 404 may be attached to the modified bucket tab 402. According to an example embodiment, the bucket tab may be modified to include a retaining key 408 that may interface with a retaining key slot 410 on the seal tab 404. In other example embodiments, the retaining key may be made on the seal tab 404 and the key slot may be made on the bucket tab, for example, in reverse to the arrangement shown in FIG. 4. According to example embodiments, the seal tab 404 may include a material that has a thermal expansion coefficient, and that is in communication with a sealing surface 406. In certain example embodiments, the sealing surface 406 may include a material that is, at least in part, makes up a sacrificial surface. For example, the sacrificial surface may be made from aluminum, or other material. In one example embodiment, the sacrificial surface may be flame spray aluminum. According to an example embodiment, part of the sacrificial surface may wear off during operation, while other parts of the sacrificial surface remain to improve the sealing tolerances associated with the seal tab 404 against the rotor dovetail slot.

Figure 5:
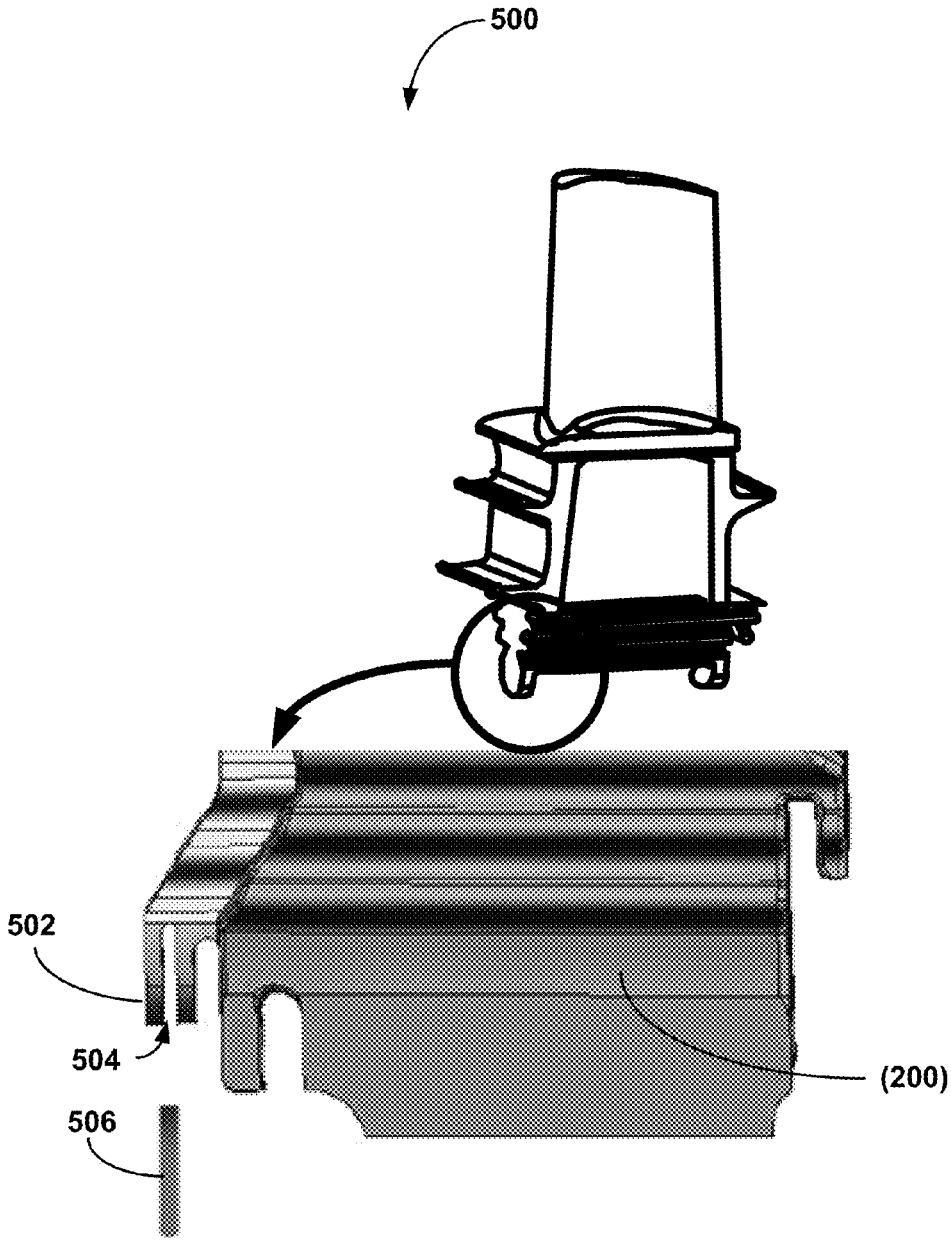
FIG. 5 is a block diagram of another illustrative bucket tab seal according to an example embodiment of the invention.

FIG. 5 depicts another example bucket tab seal embodiment 500 where a modified bucket tab 502 includes a slot 504 for retaining a seal tab 506. An example plan view and a side view of the slot 504 and the seal tab 506 is depicted in FIG. 6 for clarity.

Figure 6:
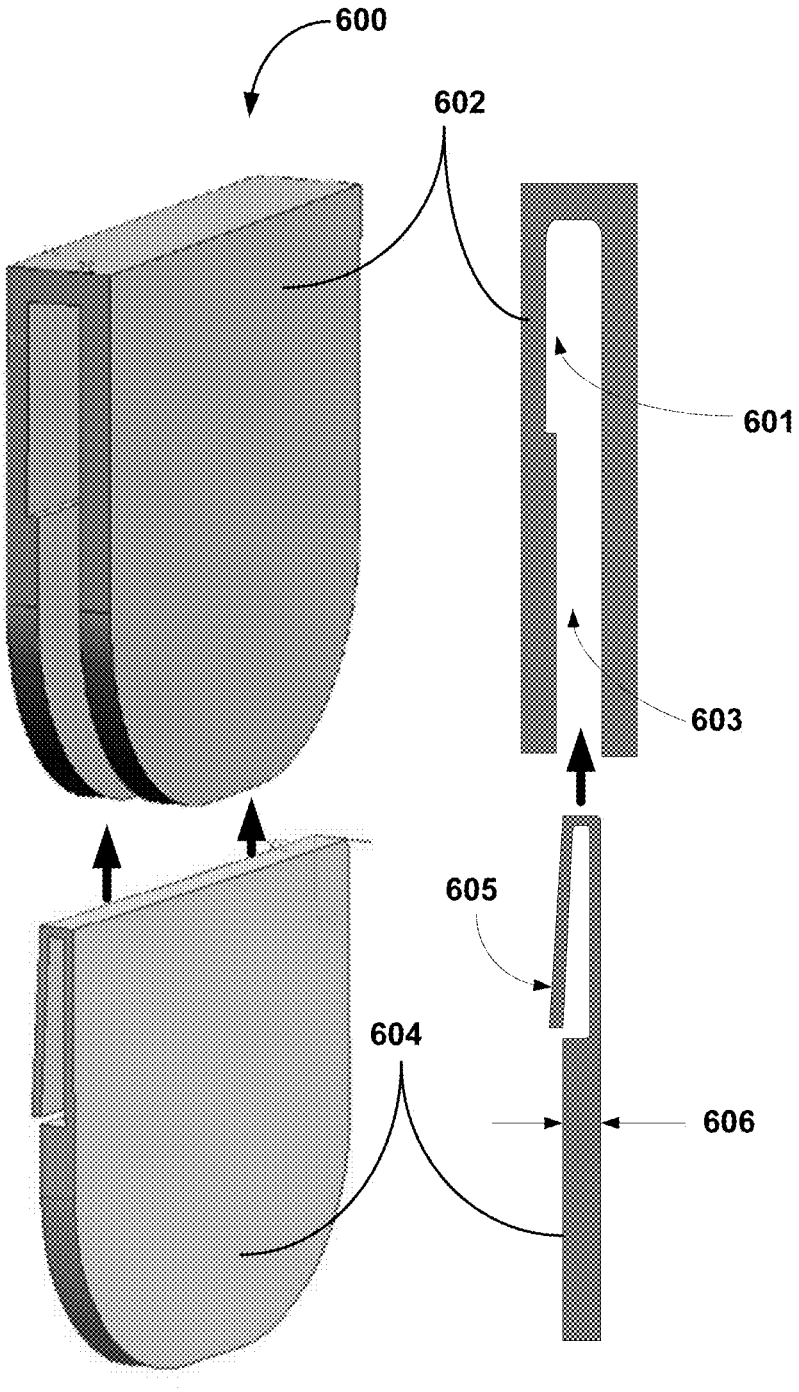
FIG. 6 is a block diagram of another illustrative bucket tab seal according to an example embodiment of the invention.

FIG. 6 depicts an example plan view and a side view of a seal tab and retaining slot 600, according to an example embodiment of the invention. In an example embodiment, the retaining slot 602 may be part of a modified bucket tab. According to an example embodiment, the retaining slot 602 may include a recessed region 601 for interfacing with a spring section 605 associated with the seal tab 604. According to an example embodiment, the spring section 605 may engage with the recessed region 601 of the retaining slot 602 when the seal tab 604 is inserted into the retaining slot 602. According to an example embodiment, the retaining slot may also have an interface region 603 with a channel width that is slightly wider than the width 606 of the seal tab 604, and so that the seal tab 604 may be inserted into the retaining slot 602 via the interface region 603. Example embodiments may provide additional channels, guides, keys, slots, etc. for retaining the seal tab 604 within the retaining slot 602.

Figure 7:
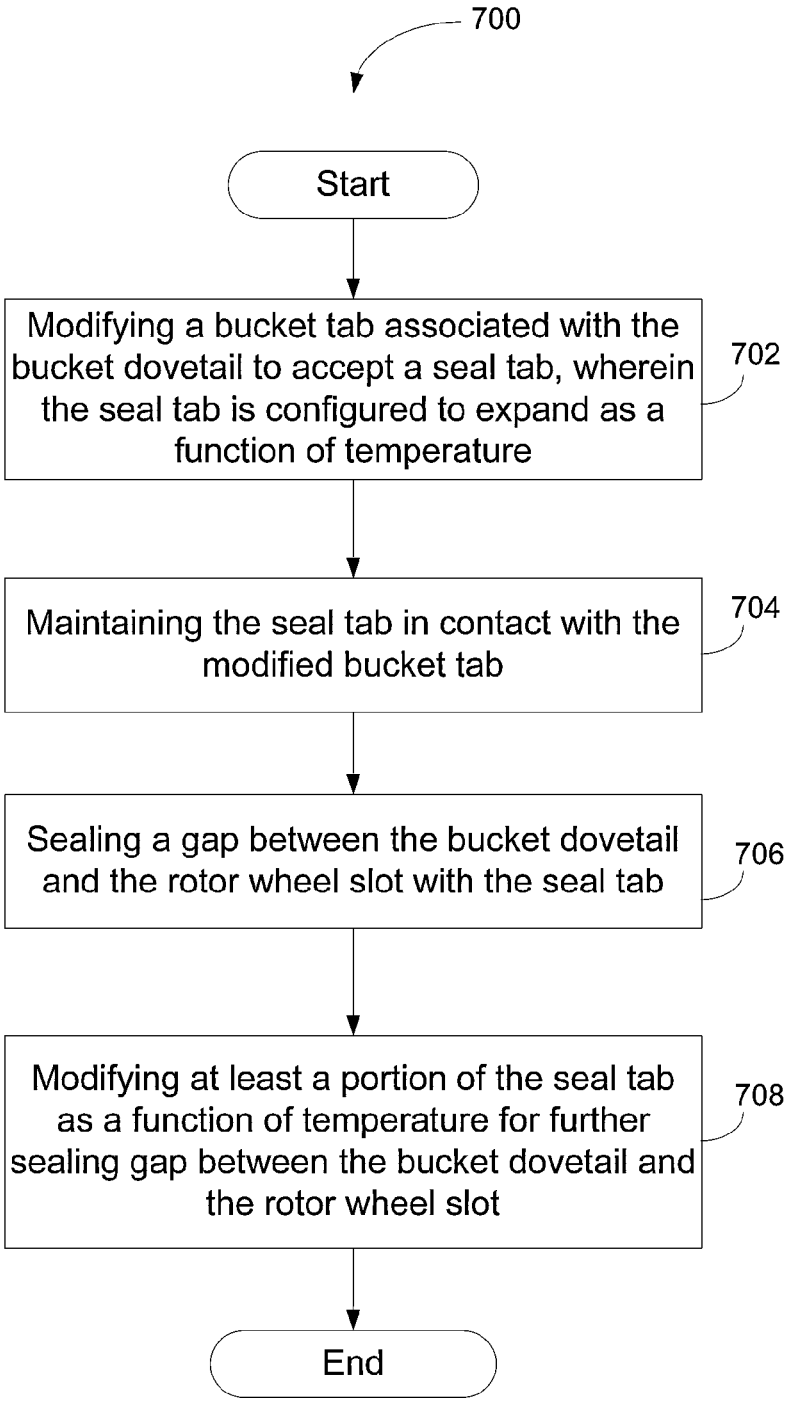
FIG. 7 is a flow diagram of an example method according to an example embodiment of the invention.

FIG. 7 shows a method 700 for sealing a gap between a bucket dovetail and a rotor wheel slot, according to an example embodiment of the invention. The method 700 starts in block 702 and includes modifying a bucket tab associated with the bucket dovetail to accept a seal tab, wherein the seal tab is configured to expand as a function of temperature. In block 704, the method 700 includes maintaining the seal tab in contact with the modified bucket tab. In block 706, the method 700 includes sealing a gap between the bucket dovetail and the rotor wheel slot with the seal tab. In block 708, the method 700 includes modifying at least a portion of the seal tab as a function of temperature for further sealing gap between the bucket dovetail and the rotor wheel slot. Method 700 ends after block 708.

According to certain example embodiments, the method 700 can further include coating at least a portion of the seal tab (304, 404) with a sacrificial layer (406) for providing gap conformity between the seal tab (304, 404) and the rotor wheel slot (202). In and example embodiment, providing gap conformity includes abrading, by at least a portion of the rotor wheel slot (202), at least a portion of the sacrificial layer (406) from the seal tab (304, 404) during operation. In an example embodiment, modifying at least a portion of the seal tab (304, 404) as a function of temperature includes expanding least a portion of the seal tab (304, 404) via a material having a coefficient of thermal expansion greater than about 0.000016 length per length per degree Celsius.

According to an example embodiment, modifying the bucket tab (106) to accept the seal tab (304) comprises forming at least one bore hole (310) through the bucket tab (106) for inserting at least one retaining pin (308) through the modified bucket tab (302) and into the seal tab (304) for retaining the seal tab (304) against at least a portion of the dovetail (104). According to an example embodiment, a diameter associated with the bore hole (310) is greater than or equal to the diameter of the at least one retaining pin (308). In an example embodiment, modifying the bucket tab (106) to accept the seal tab (404) comprises forming or attaching at least one retaining key (408) in the bucket tab (106) for mating with a corresponding retaining key slot (410) in the seal tab (404) to retain the seal tab (404) against at least a portion of the dovetail (104). According to an example embodiment, modifying the bucket tab (106) to accept the seal tab (404) includes forming or attaching at least one retaining key slot (410) in the bucket tab (106) for mating with a corresponding retaining key associated with the seal tab (404) for retaining the seal tab (404) against at least a portion of the dovetail (104).

According to another example embodiment, a system or apparatus is provided. The system includes a turbine. The turbine can include a rotor; one or more rotor wheels (200) connected to the rotor, wherein the one or more rotor wheels (200) include one or more rotor wheel slots (202); one or more buckets (102) each comprising a bucket dovetail (104) having one or more bucket tabs (106). The system or apparatus can include one or more seal tabs (304, 404) mounted to the one or more bucket tabs (106) and configured for sealing a gap between the bucket dovetail (104) and the rotor wheel slot (202), wherein the one or more seal tabs (304, 404) are configured to expand as a function of temperature. In example embodiments, the one or more seal tabs (304, 404) comprise a sacrificial layer (406) coating for providing gap conformity between the one or more seal tabs (304, 404) and the rotor wheel slot (202). In an example embodiment, at least a portion of the one or more seal tabs (304, 404) comprise a material having a coefficient of thermal expansion greater than about 0.000016 length per length per degree Celsius. According to example embodiments, the one or more bucket tabs (106) comprise at least one bore hole for inserting at least one retaining pin (308) through the one or more bucket tabs (302) and into the one or more seal tabs (304) for retaining the one or more seal tabs (304) against at least a portion of the dovetail (104). According to an example embodiment, a diameter associated with the bore hole (310) is greater than or equal to the diameter of the at least one retaining pin (308). According to example embodiments, the one or more bucket tabs (106) comprise at least one retaining key (408) for mating with a corresponding retaining key slot (410) in the one or more seal tabs (404) for retaining the one or more seal tabs (404) against at least a portion of the dovetail (104). In an example embodiment, the bucket tab (106) includes at least one retaining key slot (410) for mating with a corresponding retaining key associated with the one or more seal tabs (404) for retaining the one or more seal tabs (404) against at least a portion of the dovetail (104).

Figure 8:
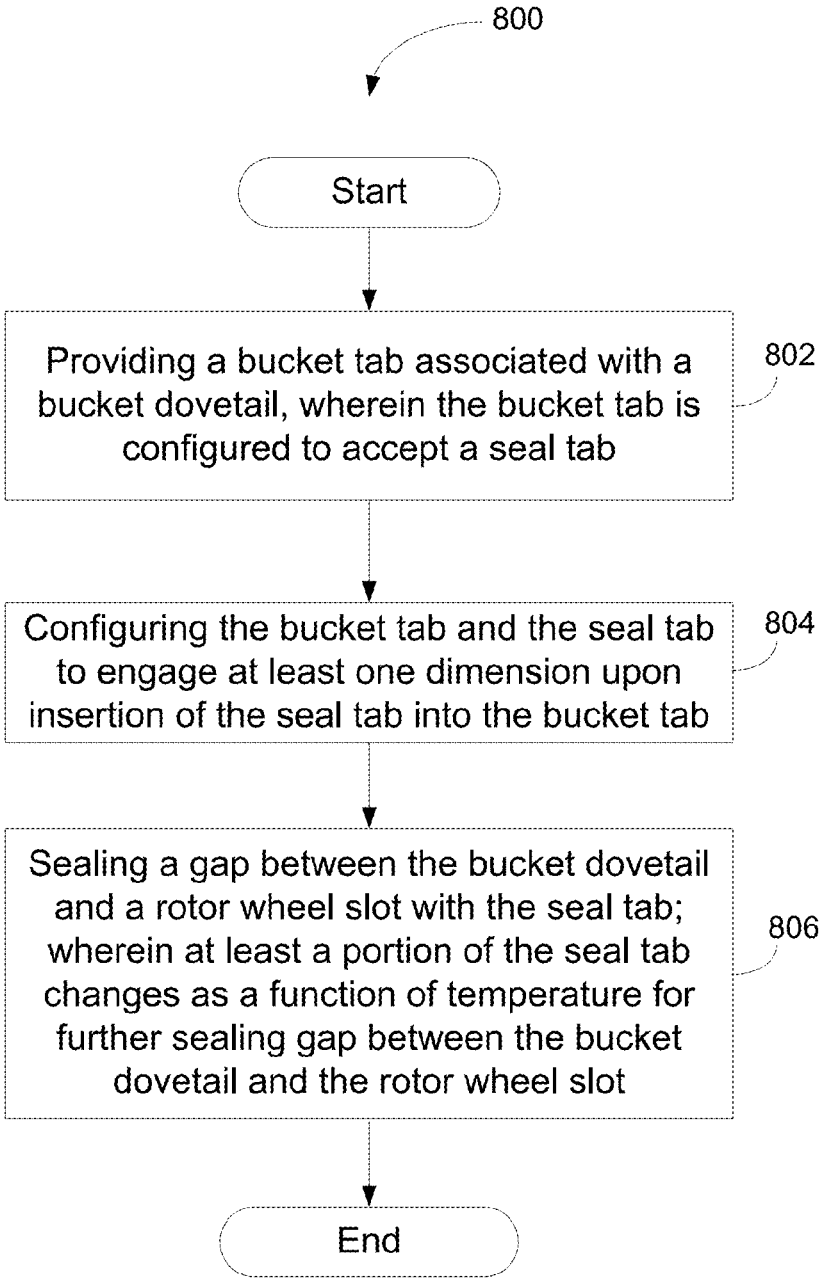
FIG. 8 is another flow diagram of an example method according to another example embodiment of the invention.

FIG. 8 shows another method 800 for sealing a gap between a bucket dovetail and a rotor wheel slot, according to an example embodiment of the invention. The method 800 starts in block 802 and includes providing a bucket tab associated with a bucket dovetail, wherein the bucket tab is configured to accept a seal tab. In block 804, the method 800 includes configuring the bucket tab and the seal tab to engage at least one dimension upon insertion of the seal tab into the bucket tab. In block 806, the method 800 includes sealing a gap between the bucket dovetail and a rotor wheel slot with the seal tab; wherein at least a portion of the seal tab changes as a function of temperature for further sealing gap between the bucket dovetail and the rotor wheel slot. Method 800 ends after block 806.

According to example embodiments, modifying the bucket tab (502, 602) to accept the seal tab (404) includes forming a slot (603) in the bucket tab (502, 602) with a slot width corresponding to an approximate body thickness (606) of bucket tab (502, 602).

According to an example embodiment, configuring the bucket tab (502, 602) and the seal tab (506, 604) to mate and lock in at least one dimension upon insertion of the seal tab (506, 604) into the bucket tab (502, 602) includes defining a slot with at least a first section (603) and a second section (604) in the bucket tab (502, 602), wherein the second section (604) comprises a slot width greater that a width associated with the first section (603). In an example embodiment, configuring the bucket tab (502, 602) and the seal tab (506, 604) to mate and lock in at least one dimension upon insertion of the seal tab (506, 604) into the bucket tab (502, 602) includes defining a spring deformable tab (605) in the seal tab (506, 604), wherein the spring deformable tab (605) is operable to engage with and be retained in the second section (604) of the bucket tab (502, 602).

According to another example embodiment, a system or apparatus is provided. The system includes a turbine. The turbine includes a rotor; one or more rotor wheels (200) connected to the rotor, wherein the one or more rotor wheels (200) comprise one or more rotor wheel slots (202); and one or more buckets (102) each comprising a bucket dovetail (104). The system and apparatus include one or more bucket tabs (502, 602) associated with each bucket dovetail (104); and one or more seal tabs (506, 604) configured for sealing a gap between the bucket dovetail (104) and the rotor wheel slot (202) and further configured to engage the one or more bucket tabs (502, 602) upon insertion of the one or more seal tabs (506, 604) into the one or more bucket tabs (502, 602). According to example embodiments, the one or more seal tabs (506, 604) are further configured to expand as a function of temperature. According to example embodiments, the one or more bucket dovetails (104) are removeably attachable to the one or more rotor wheels (200) by insertion of the bucket dovetail (104) into the one or more rotor wheel slots (202). According to example embodiments, the one or more seal tabs (506, 604) comprise a sacrificial layer coating for providing gap conformity between the one or more seal tabs (506, 604) and the rotor wheel slot (202), wherein the one or more bucket tabs (502, 602) comprise a slot width corresponding to an approximate body thickness (606) of the one or more seal tabs (506, 604). According to example embodiments, the one or more bucket tabs (502, 602) comprise a slot having at least a first section (603) and a second section (604), wherein the second section (604) comprises a slot width greater that a width associated with the first section. In an example embodiment, one or more seal tabs (506, 604) include a spring deformable tab (605), wherein the spring deformable tab (605) is operable to engage with and be retained in the second section (604) of the bucket tab (502, 602).

According to example embodiments, certain technical effects can be provided, such as creating certain systems, methods, and apparatus that provide a seal for a turbine bucket and wheel. Example embodiments of the invention can provide the further technical effects of providing systems, methods, and apparatus for expanding the seal as a function of temperature. Example embodiments of the invention can provide the further technical effects of providing systems, methods, and apparatus for providing improved sealing via a sacrificial layer on a seal tab.

In example embodiments of the invention, the bucket tab seal embodiments 300, 400 500, 600 may include any number of hardware parts to facilitate any of the operations. As desired, embodiments of the invention may include the bucket tab seal embodiments 300, 400 500, 600 with more or less of the components illustrated in FIGS. 1 through 6.

While certain embodiments of the invention have been described in connection with what is presently considered to be the most practical and various embodiments, it is to be understood that the invention is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the invention, including the best mode, and also to enable any person skilled in the art to practice certain embodiments of the invention, including making and using any devices or systems and performing any incorporated methods. The patentable scope of certain embodiments of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for sealing a gap between a bucket dovetail and a rotor wheel slot, comprising:

providing a bucket tab associated with a bucket dovetail, wherein the bucket tab is configured to accept a seal tab, the seal tab having a spring deformable tab and a non-deformable portion, wherein the spring deformable tab has a greater thickness than a thickness of the non-deformable portion;

configuring the bucket tab and the seal tab to engage at least one dimension upon insertion of the seal tab into the bucket tab by defining a slot with at least a first section and a second section in the bucket tab, wherein the second section comprises a slot width greater than a slot width associated with the first section, and the spring deformable tab of the seal tab is operable to engage with and be retained in the second section of the bucket tab; and sealing a gap between the bucket dovetail and a rotor wheel slot with the seal tab by contacting the rotor wheel slot with the seal tab; wherein at least a portion of the seal tab changes as a function of temperature for further sealing gap between the bucket dovetail and the rotor wheel slot.

2. The method of claim 1, further comprising coating at least a portion of the seal tab with a sacrificial layer for providing gap conformity between the seal tab and the rotor wheel slot.

3. The method of claim 2, wherein providing gap conformity comprises abrading, by at least a portion of the rotor wheel slot, at least a portion of the sacrificial layer from the seal tab during operation.

4. The method of claim 1, wherein at least a portion of the seal tab changes as a function of temperature by expanding via a material having a coefficient of thermal expansion greater than about 0.000016 length per length per degree Celsius.

5. The method of claim 1, wherein modifying the bucket tab to accept the seal tab comprises forming a slot in the bucket tab with a slot width corresponding to an approximate body thickness of bucket tab.

6. A system comprising:

a turbine comprising:

a rotor;

one or more rotor wheels connected to the rotor, wherein the one or more rotor wheels comprise one or more rotor wheel slots;

one or more buckets each comprising a bucket dovetail;

one or more bucket tabs associated with each bucket dovetail, wherein the one or more bucket tabs comprise a slot having at least a first section and a second section, wherein the second section comprises a slot width greater that a width associated with the first section; and one or more seal tabs comprising a spring deformable tab, the one or more seal tabs configured for sealing a gap between the bucket dovetail and the rotor wheel slot by contacting the rotor wheel slot with the one or more seal tabs, the one or more seal tabs further configured to engage the one or more bucket tabs upon insertion of the one or more seal tabs into the one or more bucket tabs, wherein the spring deformable tab is operable to engage with and be retained in the second section of the bucket tab.

7. The system of claim 6, wherein the one or more seal tabs are further configured to expand as a function of temperature.

8. The system of claim 6 wherein the one or more bucket dovetails are removeably attachable to the one or more rotor wheels by insertion of the bucket dovetail into the one or more rotor wheel slots.

9. The system of claim 6, wherein the one or more seal tabs comprise a sacrificial layer coating for providing gap conformity between the one or more seal tabs and the rotor wheel slot.

10. The system of claim 6, wherein the one or more bucket tabs comprise a slot width, the slot width corresponding to an approximate body thickness of the one or more seal tabs.

11. An apparatus for sealing a gap between a bucket dovetail and a rotor wheel slot in a turbine, the apparatus comprising:

one or more bucket tabs associated with a bucket dovetail, the one or more bucket tabs comprising a slot having at least a first section and a second section, wherein the second section comprises a slot width greater that a width associated with the first section; and one or more seal tabs comprising a spring deformable tab operable to engage with and be retained in the second section of the bucket tab, the one or more seal tabs configured for sealing a gap between the bucket dovetail and a rotor wheel slot and further configured to engage the one or more bucket tabs upon insertion of the one or more seal tabs into the one or more bucket tabs, wherein the one or more seal tabs seal the gap between the bucket dovetail and the rotor wheel slot by contacting the rotor wheel slot with the one or more seal tabs.

12. The apparatus of claim 11, wherein the one or more seal tabs are further configured to expand as a function of temperature.

13. The apparatus of claim 12, wherein the one or more bucket tabs comprise a slot width, the slot width corresponding to an approximate body thickness of the one or more seal tabs.

14. The apparatus of claim 11, wherein the one or more seal tabs comprise a sacrificial layer coating for providing gap conformity between the one or more seal tabs and the rotor wheel slot.

* * * * *